United States Patent [19]

Bachmann et al.

[11] 4,432,399

[45] Feb. 21, 1984

[54] FILLING-THREAD MONITORING DEVICE FOR JET LOOMS

[75] Inventors: Hans Bachmann, Charlotte, N.C.; Robert Frey, Ruti, Switzerland

[73] Assignee: Ruti Machinery Works Ltd., Ruti, Switzerland

[21] Appl. No.: 322,424

[22] Filed: Nov. 18, 1981

[30] Foreign Application Priority Data

Nov. 25, 1980 [CH] Switzerland ..... 8686/80

[51] Int. Cl.[3] ..... D03D 51/34

[52] U.S. Cl. ..... 139/370.2; 139/435

[58] Field of Search ..... 139/435, 370.2, 370.1, 139/302

[56] References Cited

U.S. PATENT DOCUMENTS

| | | | |
|---|---|---|---|
| 3,818,952 | 6/1974 | Vermeulen et al. . | |
| 3,880,198 | 4/1975 | Vermeulen | 139/370.2 |
| 4,082,119 | 4/1978 | Washino | 139/370.2 |
| 4,270,579 | 6/1981 | Nakanishi | 139/370.2 |
| 4,295,499 | 10/1981 | Suzuki et al. | 139/370.2 |

FOREIGN PATENT DOCUMENTS 2517471 6/1975 Fed. Rep. of Germany .

*Primary Examiner*—Henry Jaudon

*Attorney, Agent, or Firm*—Donald D. Denton

[57] ABSTRACT

A filling-thread monitoring device for jet looms in which a filling thread is guided during its introduction into the shed of a loom in a first guide channel which is formed by spaced members and is partially open on its side, contains a first filling thread stop motion means for the giving off of a signal when the filling thread introduced does not reach its normal length and a second filling thread stop motion means spaced from the first stop motion means in order to give off a signal when the filling thread introduced exceeds its normal length by a predetermined amount. Between the two filling thread stop motion means, a guide member is arranged which extends over the space which is free of warp threads and has a second guide channel which lies in the extension of the first guide channel and is closed in the filling direction. No dust can deposit in this closed second guide channel so that erroneous signals of the second filling thread stop motion means, produced by accumulations of dust which have been blown away, do not occur.

13 Claims, 2 Drawing Figures

FILLING-THREAD MONITORING DEVICE FOR JET LOOMS

BACKGROUND OF THE INVENTION

The present invention relates to a filling-thread monitoring device for jet looms in which the filling thread is guided during its insertion into the shed in a first guide channel which is formed of spaced members and is partially open on the side, having a first filling thread stop motion or stop motion means for the giving off of a signal when the filling thread introduced is less than its normal length and having a second filling thread top motion or stop motion means arranged spaced from said first stop motion means to give off a signal when the filling thread introduced exceeds its normal length by a predetermined amount.

A filling-thread monitoring device having two filling thread stop motions arranged spaced from each other is described in West German Unexamined Application for Patent OS No. 25 17 471 in combination with a tape gripper loom. This reference is the closest prior art known to the inventors. In that case the first filling thread stop motion means has the customary function of such a stop motion, i.e. it checks that a filling thread has actually been introduced and that it has its normal length and therefore that a so-called short filling is not present. The second filling-thread stop motion means serves to determine so-called long fillings, the occurrence of which as a rule is due to the fact that the filling thread has torn during introduction into the shed. Such long fillings are not detected by the first filling thread stop motion means since the entrance of the torn front part of the filling thread at the first filling thread stop motion means is interpreted by the latter as a correct insertion of a filling thread.

Since the filling thread can break during introduction into the shed also in the case of jet looms—in this case one speaks of so-called "blow-outs"—filling thread monitoring devices of the aforementioned type has been used recently also on jet looms, particularly air-jet looms. In these looms, as is known, the filling thread is guided during its insertion into the shed in a guide channel which is formed of drop wires and is partially open in radial direction. This guide channel can either be integrated in the reed, which for this purpose is imparted a special profiling, or it can be developed as a separate unit separated from the reed. In both cases the guide channel must be extended up to the second filling thread stop motion means in order that the filling thread can pass through the second filling thread stop motion means in a well defined transverse position relative to the cross-section of the shed. Accordingly, up to now a number of members which form or define the guide channel have been arranged between the first and the second filling thread stop motion means. In other words, the profiled reed or the separate guide comb was conducted up to the second filling thread stop motion means.

The first filling thread stoo motion means, as is known, is arranged outside the fabric, namely directly alongside the edge of the fabric. This is followed by a plurality of drop wires into which no warp threads are drawn, and adjoining this the second filling thread stop motion means is arranged. In the event that a so-called auxiliary or lost selvage is used, the warp threads for the auxiliary selvage are introduced into the first members after the first filling thread stop motion means, but in this case also there are free drop wires into which no warp threads are drawn.

Due to the unavoidable production of dust during the weaving, it may happen that dust deposits between the drop wires of the guide channel. If warp threads are drawn into the drop wires, the dust is continuously removed by the shedding motion thereof and it has no negative influence on the operability, particularly of the filling thread stop motion means. In the region of the members outside the warp threads, however, the dust can naturally not be removed by warp threads since none are present there. This has the result that dust continuously deposits between the members. The deposited dust forms increasing accumulations which are blown off from the drop wires when they have reached a certain size by the stream of transport air and carried along through the guide channel. As soon as such an accumulation of dust passed through the second filling thread stop motion means, it may happen that the latter interprets the accumulation of dust as a long filling and shuts down the loom even though the filling thread introduced does not exceed its normal length. Such erroneous shut-downs impair the productivity of the loom and are highly undesirable.

SUMMARY OF THE INVENTION

The aforementioned device is to be so improved by the present invention that the said erroneous shut-downs no longer occur.

This object is achieved, in accordance with the invention, in the manner that a guide member having a second guide channel which is closed in filling direction and lies in the extension of the first guide channel is arranged between the two filling thread stop motion means.

The known members which form the guide channel are therefore replaced between the two filling thread stop motion means by a compact guide member whose guide channel is closed in the filling direction.

One preferred embodiment of the device in accordance with the invention is characterized by the fact that the second guide channel has a continuous opening on its side.

In this preferred embodiment the second guide channel, which is closed in the filling direction, as well as the first guide channel are laterally open. This permits good accessibility to the second guide channel, which may be advantageous in practice for instance for possible cleaning of the second guide channel.

The last-mentioned device has proven excellent in practical tests, which was not expected in the opinion of those skilled in the art. As a matter of fact, when the guide channel is half open in radial direction, as for instance in the case of the profiled reed, it must then be seen to it that the filling thread actually remains in the guide channel and does not leave it on its open side. Up to now it has always been alleged that this could be achieved only by sufficiently dimensioned leakage points on, in particular, the side of the guide channel opposite the side opening, since the filling thread is pressed against the bottom of the guide channel by the air emerging laterally out of the guide channel through the leakage points. The man skilled in the art therefore expected that in the case of the guide member of the invention with the guide channel closed in the filling direction and without leakage points the filling thread would emerge laterally from the guide channel and fly laterally past the second filling thread stop motion means without passing through the monitoring zone of the latter. These expectations of the man skilled in the art are refuted, however, by actual practice since there is no lateral emergency of the filling thread from the guide channel.

BRIEF DESCRIPTION OF THE DRAWINGS

The invention will be explained in further detail below with reference to the illustrative embodiments shown in the drawing, in which.

BRIEF DESCRIPTION OF PREFERRED EMBODIMENTS

Figure 1:
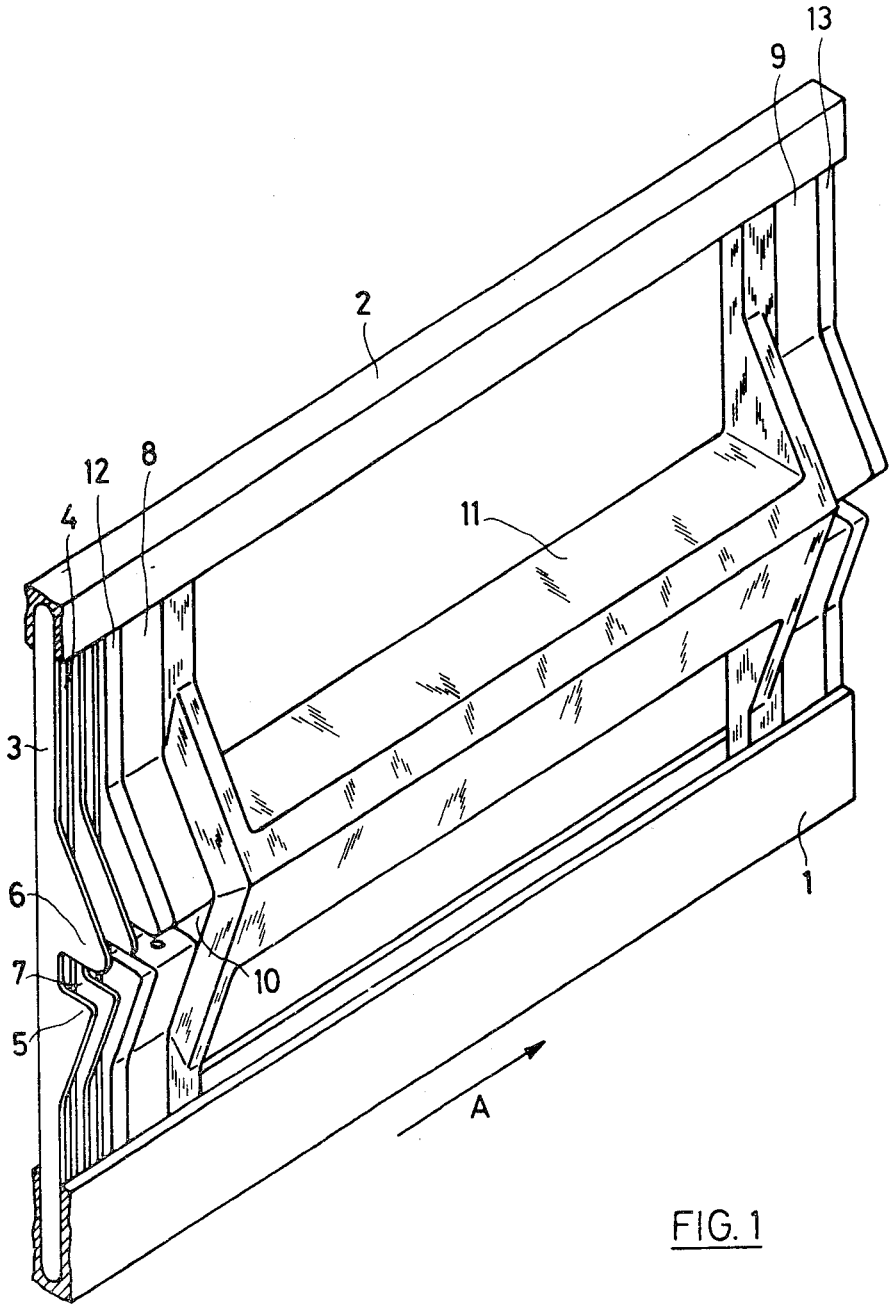
FIGS. 1 and 2 each shows a perspective view of a part of a reed with one embodiment each of a filling thread monitoring device in accordance with the invention.
Figure 2:
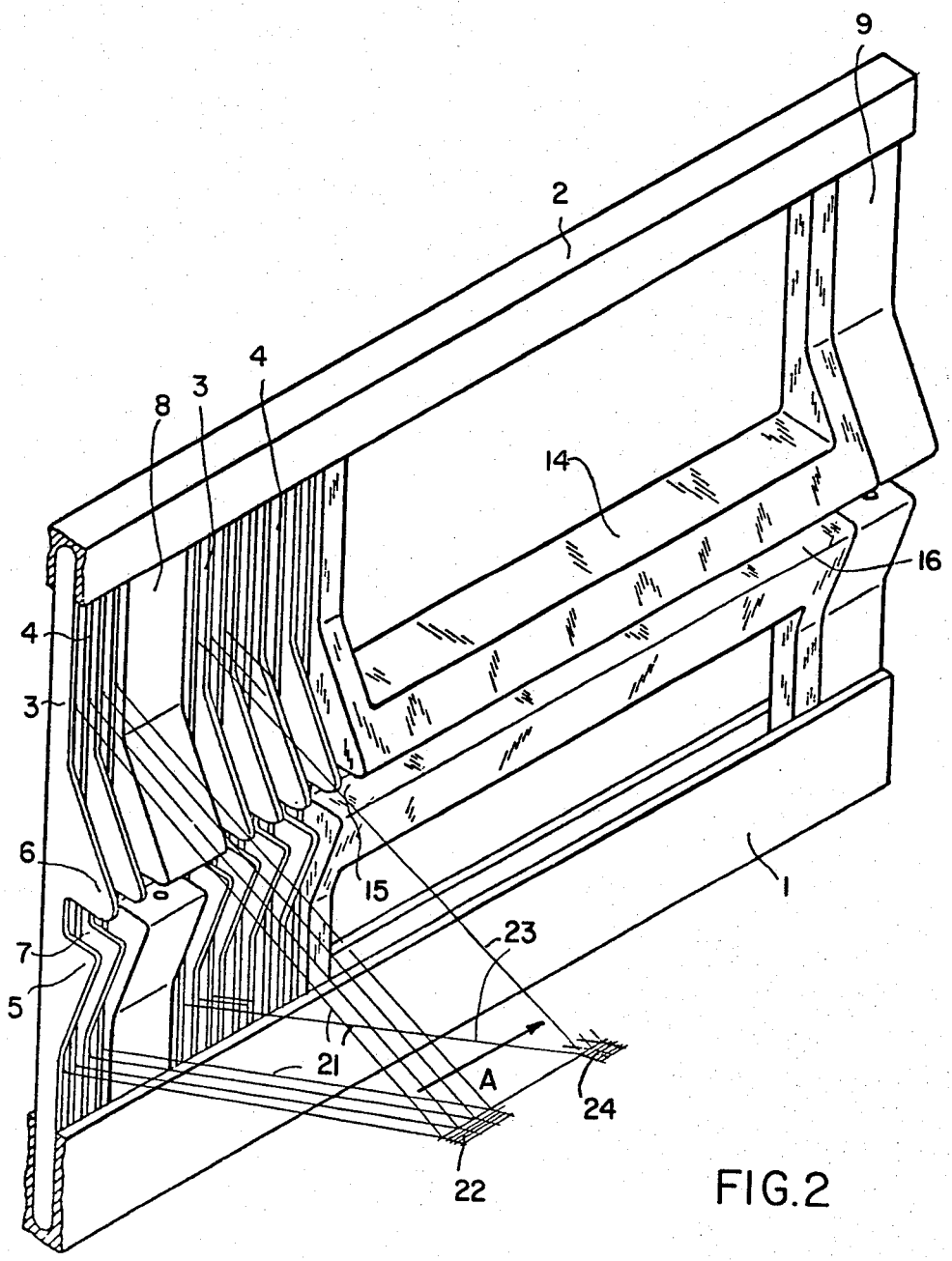

In FIGS. 1 and 2, the filling thread emergence end of a reed for an air-jet loom is shown. The reed consists of a lower frame rail 1 and an upper frame rail 2 and of profiled and straight reed blades or guide members 3 and 4 held at their ends by the frame rails. The profiled reed blades 3 have two nose-like projections 5 and 6 separated by a recess. The said recesses, which are aligned with each other, of all the profiled reed baldes 3 form a guide channel 7 for the filling threads which extends over the width of the loom. As shown in the drawing, a straight reed blade 4 is arranged between every two profiled reed blades 3, the front edge of said straight dent being aligned with the bottom of the guide channel 7.

The presence of the straight reed blades 4 is not essential for the invention and of course it would also be possible to provide no straight reed blade 4 or more than one between every two profiled reed blades 3. Similarly the distribution of the profiled and straight reed blades 3 and 4 over the width of the loom need not be constant.

The insertion of the filling is effected by a main nozzle, arranged to the side of the warp threads on the filling thread insertion side, and by auxiliary nozzles extending close to the guide channel 7 which are driven in synchronism with the reed and periodically enter in and out of the warp threads, by which nozzles the filling thread is blown in the direction indicated by the arrow A through the guide channels 7 and thus inserted into the shed. The use and arrangement of the individual nozzles is assumed to be known and has therefore not been shown. Reference may be had in this connecton to U.S. Pat. No. 3,818,952, the contents of which are made a part of this disclosure by way of reference.

The reed blades or guide members 3 and 4 shown to the far left in FIGS. 1 and 2 are present on the edge of the fabric on the emergence side of the filling thread, and the selvage warp threads are therefore pulled in between these reed blades on the loom. FIG. 2 shows the warp thread 21 of the fabric 22 and the warp thread 23 of the auxiliary selvage 24. Adjoining these reed blades in the filling direction A there is the device in accordance with the invention two examles of which are shown, on in FIG. 1 and the other in FIG. 2. Both examples have the feature in common of a first filling thread stop motion means 8 adjoining the reed blades 3,4 for the selvage warp threads and a second filling thread stop motion means 9 arranged spaced from the first.

The two filling thread stop motion means 8 and 9 may be of an optical-electronic type device, the shape of which is adapted to that of the profiled reed blades 3, and be operatively associated with the function and control mechanism of the jet loom. The first filling thread stop motion means 8 serves to check that the filling thread introduced has reached filling is present, i.e. the filling thread does not pass through the first warp thread stop motion means 8, the latter gives off a signal by which the machine is stopped.

If the filling thread tears during its insertion into the shed, then its torn front part will fly further and either be blown entirely out of the guide channel 7 in the direction A or else be caught by the warp threads of the closing shed before it has emerged from it. In the former case, the inserted filling thread is too short while in the latter case a "filling thread hole" is produced. Both represent a defect in the weave. The first filling thread stop motion means or device 8 cannot detect this defect since it interprets the flying past of the torn front part of the filling thread to mean that the filling thread has reached its normal length and thus a proper filling insertion is present.

In order to detect these long fillings, which generally result from so-called filling blow-outs, there is employed the second filling thread stop motion means or device 9 which gives off a signal which stops the loom when it detects the flying past of a filling thread. The distance between the two filling thread stop motion means 8 and 9 is so selected that in the event of a proper insertion of the filling, the tip of the filling thread definitely does not reach the second filling thread stop motion means 9. Thus each arrival of the tip of the filling thread at the second filling thread stop motion means 9 is a reliable indication of a long filling and therefore a defective filling. In this connection, reference is also had to West German Unexamined Application for Patent OS No. 25 17 471.

In air-jet looms there is the difference from the device with two filling thread stop motions described in West German Unexamined Application for Patent OS No. 25 17 471 for a tape-gripper loom, that the first filling thread introduced after each start of the machine customarily exceeds its normal length. Therefore, the distance between the filling thread stop motion means 8 and 9 must be selected so great that even the first filling thread after each start does not reach the second filling thread stop motion means 9. From this requirement there results in practice a distance between the two filling thread stop motion means 8 and 9 of an amount of up to about 20 cm.

This distance, even if it were considerably smaller, must now be bridged over by guide means for the filling thread in order that each long filling actually also passes through the range of detection of the second filling thread stop motion means 9 in the channel-like portion thereof which is aligned with the guide channel 7.

Such guide means are shown in each of FIGS. 1 and 2.

In accordance with FIG. 1, the space between the filling thread stop motion means 8 and 9 is bridged by a guide member 11 which has a closed guide channel 10 for the filling thread. The closed guide channel 10 has the same or approximately the same cross-section as the guide channel 7 and is aligned with it, and the two filling thread stop motion means 8 and 9 are arranged directly in front of and behind the guide member 11, respectively. Since the guide channel 10 is closed, the jet of transport air remains bundled in this region and the filling thread can be transported through the guide channel 10 without auxiliary nozzles or similar means.

The guide member 11 consists of a dust-repelling plastic and is preferably made by injection molding. It is connected on its sides with the filling thread stop motion means 8 and 9, which in their turn are fastened to attached blades 12 and 13 inserted into the frame rails 1 and 2, for instance screwed to them. The attached blades 12 and 13 have a profiling similar to the profiled reed blades 3 but are considerably thicker than the latter. Their thickness is about 2 mm.

The outer shape of the guide member 11 is of secondary importance; it could, for instance, also be tubular. It would also be possible to combine the guide member 11 with the filling thread stop motion means 8 and 9 so as to form a single element and integrate the filling thread stop motion means 8 and 9 into the guide member 11.

The arrangement shown in FIG. 1 is intended for a loom on which the fabric is produced without auxiliary or loss selvage. If such a loom is to be used, then the first filling thread stop motion means 8 is arranged in the space between the edge of the fabric and the auxiliary selvage, and reed blades for the warp threads of the auxiliary selvage are arranged between the first filling thread stop motion means 8 and the guide member 11 (see also FIG. 2).

In the embodiment shown in FIG. 2, a guide member 14 is used having a guide channel 15 which is closed in the filling direction A with the exception of an opening 16 on one side. The guide channel 15 corresponds to the guide channel 7 and extends the latter up to the second filling thread stop motion means 9. Here auxiliary nozzles of the aforementioned type are provided also in the region of the guide channel 15. The filling thread stop motion means 8 and 9 and the guide member 14 are inserted into the frame rails 1 and 2. Of course, they could also be mounted on special attachment blades or both types of attachments could be combined. The same applies, vice versa, for FIG. 1.

As shown in the drawing, read blades 3 and 4 are arranged between the first filling thread stop motion means 8 and the guide member 14. They serve to produce an auxiliary selvage. If such an auxiliary selvage is not required, then the guide member 14 directly adjoins the first filling thread stop motion means 8.

In both embodiments the guide channel 7 for the filling thread within the shed is integrated into the reed. There are also air-jet looms in which the guide channel is separate from the reed and the latter accordingly has only straight reed blades. The separate guide channel consists in this case either of relatively closely arranged thin half-open members or of less closely arranged, somewhat thicker half-open members provided only with a thread emergence slot; or of closely arranged thick members provided with a thread emergence slot. The arrangement described can also be used in combination with all of these systems, since the determinative factor is only that the space free of warp threads between the two filling thread stop motion means be bridged by a guide member which has a guide channel for the filling thread which is closed at least in the filling direction.

It will be appreciated that various changes and/or modifications may be made within the skill of the art without departing from the spirit and scope of the invention illustrated, described, and claimed herein.

What is claimed is:

1. A filling-thread monitoring device for jet looms in which the filling thread is guided during its insertion into the shed, in a first guide channel which is partially open on the side and formed by spaced members having a first filling thread stop motion means for the giving off of a signal when the filling thread introduced is less than its normal length and having a second filling thread stop motion means spaced from the latter to give off a signal when the filling thread introduced exceeds its normal length by a predetermined amount, characterized by the fact that between the two filling thread stop motion means there is arranged a guide member having a second guide channel which is open at its entrance and exit ends, is closed in the filling direction on substantially all sides, and lies in the extension of the first guide channel.

2. The filling-thread monitoring device according to claim 1 in which the second guide channel is closed on all sides.

3. The filling-thread monitoring device according to claim 1 in which the second guide channel has a continuous opening on its side.

4. The filling-thread montoring device according to claim 2 or 3 in which said guide member extends over the space which is free of warp threads between the two filling thread stop motion means.

5. The filling-thread monitoring device according to claim 4 for jet looms for the production of fabric having an auxiliary selvage, the first filling thread stop motion means being arranged between the edge warp threads of the fabric and the warp threads for the auxiliary selvage, characterized by the fact that the guide member extends from the warp threads for the auxiliary selvage up to the second filling thread stop motion means.

6. The filling-thread monitoring device according to claim 4 for jet looms in which the first filling thread stop motion means is arranged adjoining the edge warp threads of the fabric, characterized by the fact that the guide member extends from the first filling thread stop motion means to the second filling thread stop motion means.

7. The filling-thread monitoring device according to claim 6 in which the guide member is connected with said two filling thread stop motion means so as to form a single structural unit.

8. The filling-thread monitoring device according to claim 7 in which the two filling thread stop motion means are integrated in the guide member.

9. The filling-thread monitoring device according to claim 4 in which the guide member is formed from a dust-repellent plastic.

10. The filling-thread monitoring device according to claim 4 for jet looms, in which the first guide channel is formed by recesses in corresponding shaped reed blades, characterized by the fact that the said two filling thread stop motion means and the guide member are mounted in an extension piece of the reed.

11. The filling-thread monitoring device according to claim 10 in which the extension piece is detachably connected to the reed.

12. The filling-thread monitoring device according to claim 10 characterized by the fact that the two filling thread stop motion means and the guide member are inserted into the reed.

13. The filling-thread monitoring device according to claim 1 in which said two filling thread stop motion means are optical-electronic devices operatively associated with the functioning of the jet loom.

* * * * *